US007931052B2

(12) United States Patent
Schooley

(10) Patent No.: US 7,931,052 B2
(45) Date of Patent: Apr. 26, 2011

(54) VACUUM STORAGE CONTAINER

(76) Inventor: Bruce A. Schooley, Alamo, CA (US)

( * ) Notice: Subject to any disclaimer, the term of this patent is extended or adjusted under 35 U.S.C. 154(b) by 1175 days.

(21) Appl. No.: 11/540,847

(22) Filed: Sep. 29, 2006

(65) Prior Publication Data

US 2007/0095713 A1 May 3, 2007

Related U.S. Application Data

(60) Provisional application No. 60/711,621, filed on Oct. 27, 2005.

(51) Int. Cl.
*B65B 31/04* (2006.01)

(52) U.S. Cl. ..... 141/65; 141/8; 220/212; 215/228; 99/472

(58) Field of Classification Search ..... 141/4, 7, 141/8, 65, 98; 220/212; 215/228; 99/472
See application file for complete search history.

(56) References Cited

U.S. PATENT DOCUMENTS

| | | | | | |
|---|---|---|---|---|---|
| 2,745,217 | A | * | 5/1956 | Gold et al. | 99/472 |
| 3,769,902 | A | | 11/1973 | Hurwitz | |
| 4,051,971 | A | | 10/1977 | Saleri | |
| 4,218,967 | A | | 8/1980 | Batchelor | |
| 4,339,054 | A | | 7/1982 | Kellogg | |
| 4,362,095 | A | | 12/1982 | Wheatley | |
| 4,591,508 | A | | 5/1986 | Pultinas, Jr. | |
| 4,901,634 | A | | 2/1990 | Kuwahara | |
| 5,142,970 | A | | 9/1992 | ErkenBrack | |
| 5,195,427 | A | | 3/1993 | Germano | |
| 5,398,811 | A | | 3/1995 | Latella, Jr. | |
| 5,405,038 | A | | 4/1995 | Chuang | |
| 5,406,992 | A | | 4/1995 | Miramon | |
| 5,564,581 | A | * | 10/1996 | Lin | 215/228 |
| 5,651,470 | A | | 7/1997 | Wu | |
| 5,692,632 | A | * | 12/1997 | Hsieh et al. | 220/212 |
| 5,765,608 | A | | 6/1998 | Kristen | |
| 5,803,282 | A | | 9/1998 | Chen | |
| 5,806,575 | A | | 9/1998 | Tsay | |
| 5,921,102 | A | | 7/1999 | Vago | |
| 5,941,391 | A | | 8/1999 | Jury | |
| D414,381 | S | | 9/1999 | Schmidt | |
| 5,964,255 | A | | 10/1999 | Schmidt | |
| 6,035,769 | A | * | 3/2000 | Nomura et al. | 99/472 |
| 6,557,462 | B1 | * | 5/2003 | Wang | 99/472 |
| 6,783,021 | B2 | | 8/2004 | Kaura | |
| 6,830,081 | B1 | * | 12/2004 | Chen | 141/65 |
| 7,040,356 | B2 | * | 5/2006 | Tarlow | 141/65 |
| 7,571,748 | B2 | * | 8/2009 | Shao | 141/66 |
| 7,721,771 | B2 | * | 5/2010 | Tsay | 141/65 |

OTHER PUBLICATIONS

Vendio.com; Deni JarVac Vacuum Packaging System & Jar Re-Sealer.

* cited by examiner

*Primary Examiner* — Timothy L Maust
(74) *Attorney, Agent, or Firm* — Heisler & Associates

(57) ABSTRACT

A container is provided for storing items in a vacuum state. The container includes a receptacle with associated lid. A lever and clamp act together as a toggle to exert a relatively high closure force on the lid. The container includes a vacuum pump, preferably within a base of the container. A switch is provided to activate and deactivate the pump which is activated by the lever when the lever is pivoted to a closed position. A sensor is optionally also provided to shut off the pump when a sufficiently low pressure is reached. The lid includes a bleed port which is closed by the clamp when the lid is closed. When the lever and clamp are pivoted to an open position, this bleed port is opened so that pressure equalization occurs and the lid can be easily opened without fighting atmospheric pressure forces acting on the lid.

26 Claims, 3 Drawing Sheets

VACUUM STORAGE CONTAINER

CROSS-REFERENCE TO RELATED APPLICATIONS

This application claims benefit under Title 35, United States Code §119(e) of U.S. Provisional Application No. 60/711,621 filed on Oct. 27, 2005.

FIELD OF THE INVENTION

The following invention relates to storage containers which maintain an at least partial vacuum therein. More particularly, this invention relates to vacuum storage containers that include a vacuum pump for restoring vacuum after opening and reclosing the container.

BACKGROUND OF THE INVENTION

Food preservation experts have long known that comestibles keep fresh longer and are generally preserved when kept within a vacuum or partial vacuum environment. At least one reason for this benefit is that the food items are less able to undergo various oxidation reactions when oxygen is not present or less present. Accordingly, various devices have been provided in the prior art for sealing comestibles within vacuum or partial vacuum environments. Most such devices have been in two parts including the vacuum pump and associated structure separate from a food container. The vacuum pump is temporarily coupled to the food container and the vacuum is drawn. The food container is then sealed, sealing out the surrounding atmosphere and maintaining, an at least partial vacuum environment within the container. The container is then disconnected from the vacuum pump.

While such general equipment and food preservation methodologies are generally effective, they do not provide the highest degree of convenience. In particular, it is always required that the vacuum pump apparatus and the container be present. The vacuum equipment is typically bulky and beneficially kept in a single location. Also, there are times when a user has a container available which could support a vacuum but no access to a vacuum pump. Accordingly, a need exists for a container which has a vacuum pump integrally included therewith so that comestibles or other items placed within the container can be made both portable and always maintained in a vacuum or semi-vacuum state.

At least one prior art patent (U.S. Pat. No. 5,964,255 to Schmidt) teaches such a container which includes an integrally formed vacuum pump. The device taught by Schmidt as well as other related products are not entirely satisfactory in satisfying the needs of a user who wishes to maintain comestibles or other items in a state of at least partial vacuum and provide a convenience and ease of use which discerning customers have become accustomed. In particular, a need exists for such a vacuum container which readily operates in an intuitive fashion so that a user need merely place comestibles or other items within the container, close the container and latch the container, with the container itself efficiently and effectively performing the remaining procedure of creating a vacuum within the container. Such a container should also be easily openable even when securely sealed, despite the significant atmospheric forces acting on the lid which must be overcome when a vacuum condition exists within the container and opening is desired.

SUMMARY OF THE INVENTION

With this invention, a container is provided with an enclosed interior space which can maintain a vacuum therein.

The container includes a receptacle selectively openable and closable with a lid that is preferably hingedly attached to the receptacle. A vacuum pump is preferably coupled to the receptacle, such as within a base below the receptacle, with the pump in communication with the interior space of the receptacle for drawing air or other gases out of the receptacle.

The container preferably includes a lever and clamp which work together to apply a relatively high degree of closing force easily on the lid, sufficient to compress a gasket that is preferably provided between the lid and a rim of the receptacle. Thus, a user can easily apply a high degree of force to provide a substantially completely sealed interior space within the receptacle.

Most preferably, this lever is also oriented adjacent a switch which activates the pump when the lever is pivoted to a closed position after having closed the lid. In this way, the user need not separately depress a button or other switch to activate the pump. Rather, the mere act of closing the lid and sealing it through action of the clamp and lever also causes the pump to be activated.

Most preferably, a pressure sensor is included in communication with the interior space within the receptacle and also coupled to a control system in communication with the pump. This pressure sensor is configured through the control system to deactivate the pump when a pressure within the interior space of the receptacle (or otherwise upstream of the vacuum pump) is sufficiently low. Should the vacuum condition for some reason be lost within the interior space of the receptacle, this pressure sensor would detect such condition and the pump would automatically be turned on to restore the vacuum condition within the receptacle.

In a most preferred form of this invention, a bleed port is provide between the interior space of the receptacle and the surrounding environment, most preferably within the lid. This bleed port is provided to allow air to return into the interior space of the receptacle when the receptacle is to be opened. Without such a bleed port, a user would need to overcome atmospheric pressure forces tending to keep the lid closed once a vacuum has been drawn on the interior space within the receptacle.

The bleed port includes a valve which is biased toward an open position and is most preferably held closed by the clamp coupled to the lever. Thus, when the lever is pivoted towards an open position, and forces are relieved between the clamp and the valve on the port, the port returns to its open position and air or other gases are allowed to bleed into the interior space of the receptacle. Equilibrium is quickly restored between the interior space within the receptacle and the surrounding atmosphere. The lid can then be easily opened to allow a user to access comestibles or other items stored within the receptacle.

OBJECTS OF THE INVENTION

Accordingly, a primary object of the present invention is to provide a container in which food stuffs, comestibles or other items can be stored while in a vacuum or partial vacuum condition.

Another object of the present invention is to provide a container which can both maintain a vacuum therein and which also includes a vacuum pump for creating a vacuum condition within the container.

Another object of the present invention is to provide a container which can maintain a vacuum therein and which has a vacuum pump which is automatically turned on when the container is closed and automatically turned off when a desired sufficiently low pressure is achieved.

Another object of the present invention is to provide a vacuum storage container which is easily opened when desired.

Another object of the present invention is to provide a vacuum storage container which includes a bleed port for pressure equalization before opening of the container.

Another object of the present invention is to provide a container in which food items can be stored and transported while in a vacuum state or partial vacuum state, and be openable and reclosable and able to return to a vacuum or partial vacuum state after being reclosed, repeatedly.

Other further objects of the present invention will become apparent from a careful reading of the included drawing figures, the claims and detailed description of the invention.

DESCRIPTION OF THE PREFERRED EMBODIMENT

Figure 1:
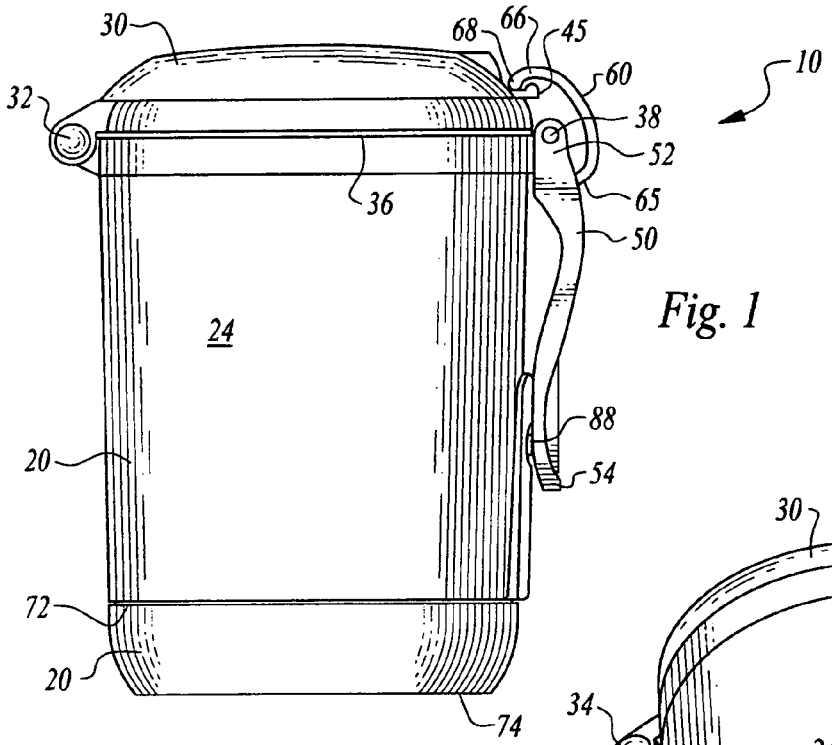
FIG. 1 is a front elevation view of the vacuum storage container of this invention with the container shown closed.
Figure 2:
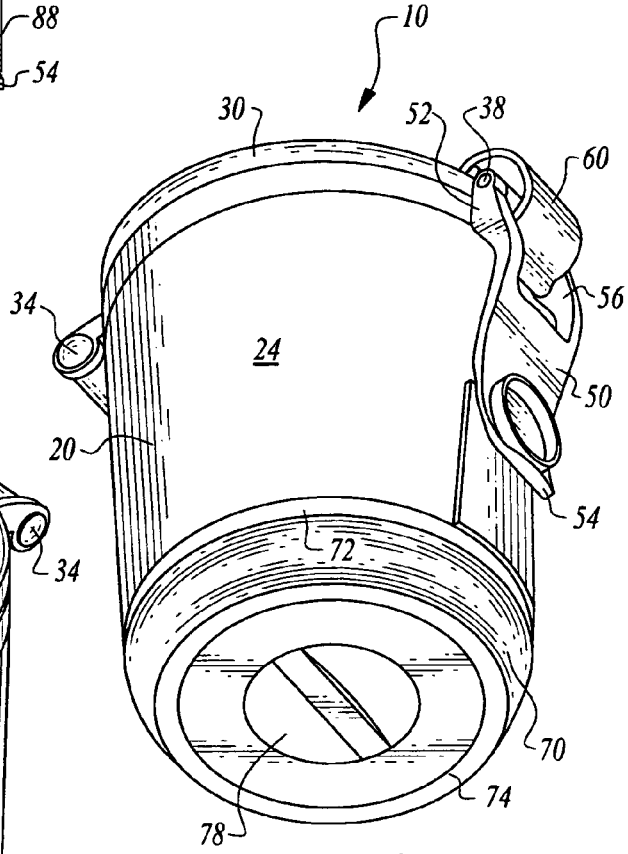
FIG. 2 is a perspective view of that which is shown in FIG. 1 shown from below.
Figure 3:
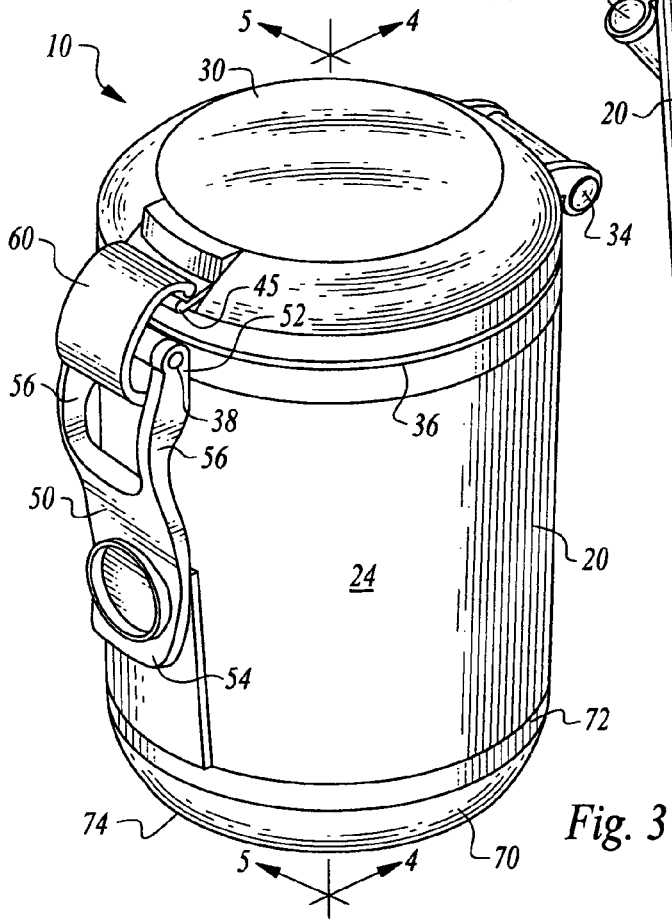
FIG. 3 is a perspective view of that which is shown in FIG. 1 shown from above.

Referring to the drawings, wherein like reference numerals represent like parts throughout the various drawing figures, reference numeral 10 is directed to a vacuum storage container (FIGS. 1-5). The container 10 includes a receptacle 20 which can be selectively opened and closed with a lid 30. A base 70 is also provided in which a vacuum pump 80 is located. Thus, the container 10 both provides a receptacle 20 for storage of comestibles and other items within a vacuum or partial vacuum environment, but also provides a pump 70 for providing and resupplying a vacuum condition within a substantially enclosed interior space within the receptacle 20 of the container 10.

In essence, and with particular reference to FIGS. 1-5, basic details of the vacuum storage container 10 of this invention are described according to a preferred embodiment. The container 10 includes a receptacle 20 surrounding and enclosing an interior space when closed with a lid 30. The lid 30 is preferably pivotably attached to the receptacle 20 so that the lid 30 can pivot between an open position (FIG. 7) and a closed position (FIGS. 1-6).

A bleed port 40 is provided, preferably within the lid 30, which allows for pressure equalization between the interior space within the receptacle 20 and a surrounding atmosphere, such as just before the lid 30 is to be opened. This bleed port 40 has a valve plate 46 (FIGS. 5, 8 and 9) which is biased toward an open position to maintain equilibrium. When the lid 30 is closed and forces are applied to this valve plate 46 of the port 40 to close the bleed port 40, a vacuum can be drawn and maintained on the enclosed interior space of the receptacle 20.

A lever 50 is preferably pivotably attached to the receptacle 20 with a clamp 60 in turn pivotably attached to the lever 50. The lever 50 and clamp 60 thus act as a form of toggle mechanism to provide a mechanical advantage for a user in closing the lid 30 securely against the receptacle 20. The clamp 60 is preferably also configured to close the valve plate 46 over the bleed port 40 within the lid 30 when the lid 30 is in this closed state.

A base 70 is provided at a lower end of the receptacle 20. The base 70 preferably houses the vacuum pump 80 as well as batteries 90 for powering the vacuum pump 80. A sensor 100 is also provided within the base 70 for monitoring pressure within the interior space of the receptacle 20. A control system and associated electric circuitry couple the batteries 90 to the pump 80 and along with the sensor 100, as well as a switch 86 for the pump 80, to control operation of the pump 80 as described in more detail herein.

Figure 5:
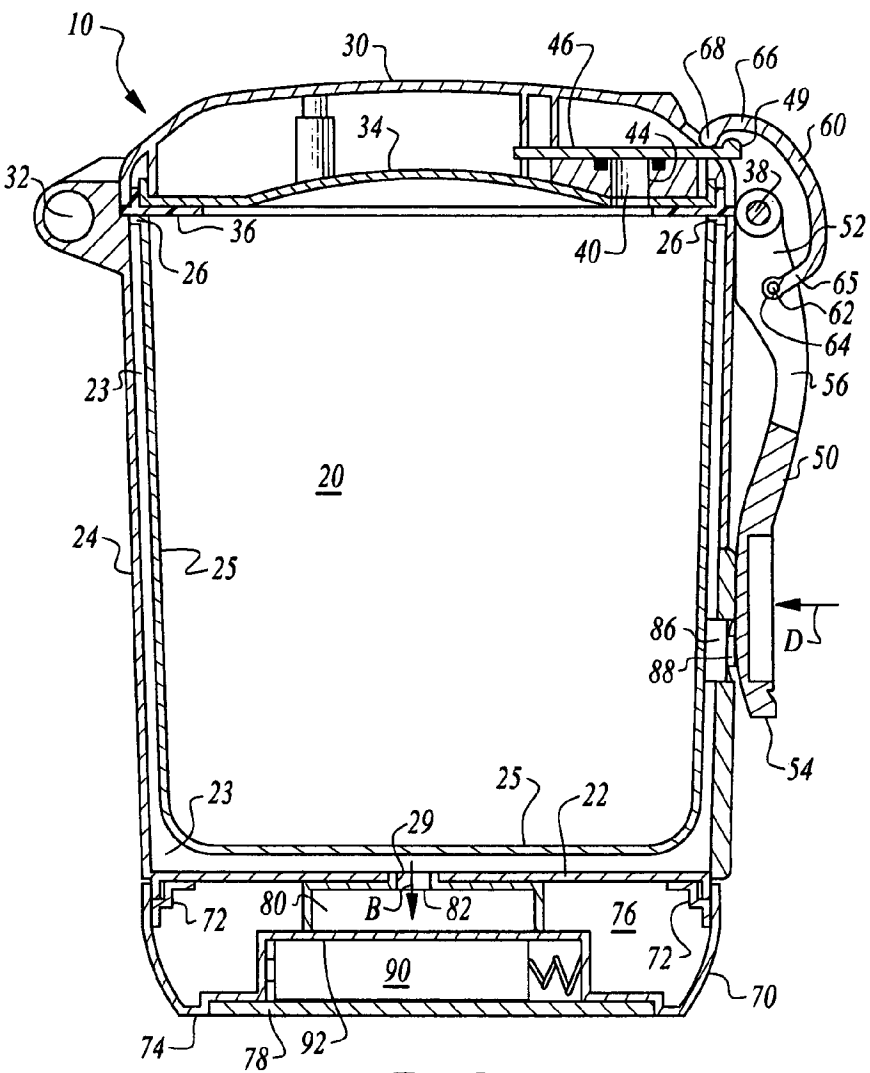
FIG. 5 is a front elevation full sectional view of that which is shown in FIGS. 1-3, taken along lines 5-5 of FIG. 3.
Figure 4:
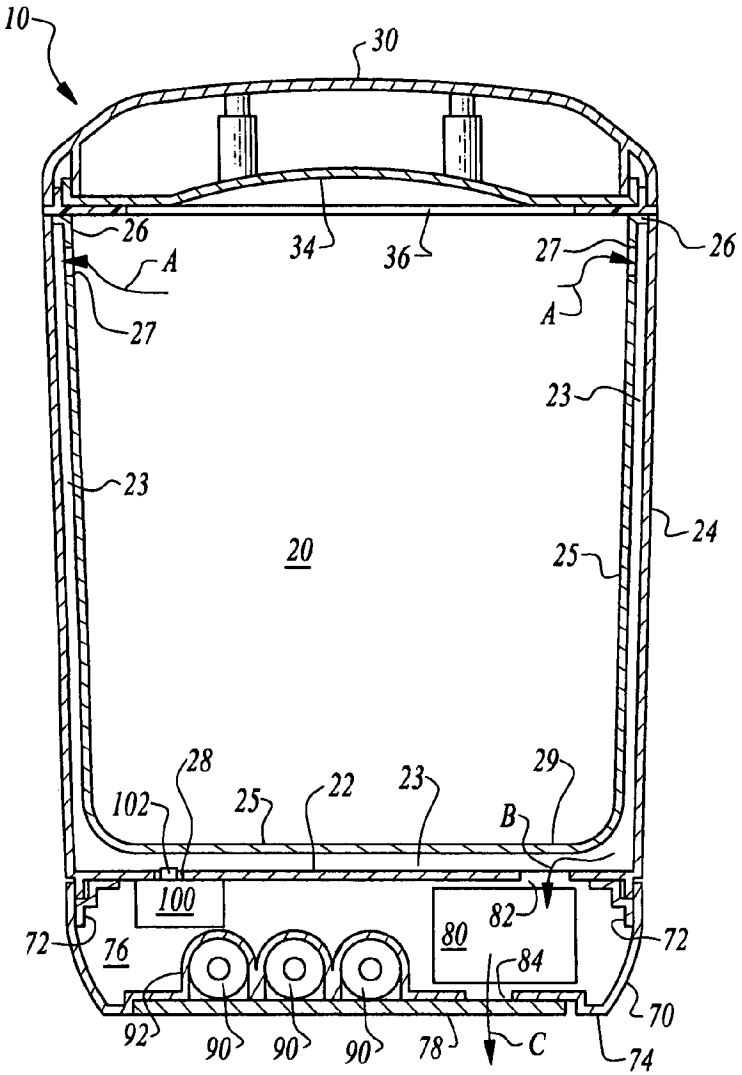
FIG. 4 is a side elevation full sectional view of that which is shown in FIGS. 1-3 and taken along lines 4-4 of FIG. 3.

More specifically, and with particular reference to FIGS. 4 and 5, basic details of the receptacle 20 of the vacuum storage container 10 are described, according to the preferred embodiment. While the receptacle 20 can be any of a variety of different shapes which are generally hollow to surround a substantially enclosed interior space, the receptacle 20 is most preferably generally cylindrical in form. The receptacle 20 thus includes a floor 22 which is substantially flat with a side wall 24 extending cylindrically up from a perimeter of the floor 22. The side wall 24 preferably terminates at a rim 26 which is preferably substantially circular. This rim 26 abuts against the lid 30 as described in detail below.

A liner 25 is preferably located inboard of the side wall 24 and over the floor 22. A gap 23 is provided between the liner 25 and the side wall 24 and floor 22. This liner 25 conveniently can be made of a material which is easily washable and of an easily cleaned and durable character which makes it suitable for use with foodstuffs, comestibles or other particular items to be contained within the container 10.

The liner 25 preferably includes some means for allowing air or other gases to pass through the liner 25 from the interior space to the gap 23. This means for gas passage could include that the liner 25 is merely gas permeable to some degree greater than that exhibited by the side wall 24. Most preferably, however, the liner 25 includes evacuation ports 27 (FIG. 4) near where the liner 25 abuts the rim 26. These evacuation ports 27 can merely be a series of small holes just below the rim 26 of the receptacle 20 and passing through the liner 25 and into the gap 23. These evacuation ports 27 provide a path along which air or other gases can travel when being removed from the interior space within the receptacle 20 by the vacuum pump 80. Most preferably, the liner 25 also provides a covering for the rim 26. The liner 25 is optionally made to be removable should the liner 25 become damaged or soiled, or otherwise be desired to be replaced or removed for thorough cleaning.

The floor 22 of the receptacle 20 preferably includes a sensor hole 28 and a pump hole 29 passing therethrough. These holes 28, 29 allow the sensor 100, through a sensor input 102 to pass into the gap 23, as well as the inlet 82 of the pump 80 through the pump hole 29. Thus, pressure within the gap 23 can be sensed, which gap pressure is similar to that within an interior space inboard of the liner 25. Also, air or other gases can be removed from the gap 23 through the inlet 82 and pump hole 29 by action of the pump 80.

The gap 23 is preferably of exceptionally small volume, so that a volume of space inboard of the liner 25 can be maximized. The liner 25 is preferably a hard plastic material. The side wall 24 is preferably sufficiently strong and sealed to maintain a pressure differential between a surrounding atmosphere and the interior of the receptacle 20. Thus, air or other gases can easily be drawn out of the interior of the liner 25 and out of the gap 23 through the pump hole 29 by the pump 80 without particular concern that the gap 23 be maintained in a sufficiently open condition.

With continuing reference to FIGS. 1-5, details of the lid 30 are described. The lid 30 provides a preferred form of means to selectively open and close the receptacle 20 of the container 10. While the lid 30 could translate vertically into an opening defined by the rim 26 of the receptacle 20, either without rotation or with rotation, such as through action of threads, most preferably the lid 30 pivots (about arrow I of FIG. 7) between an open and closed position. To facilitate such pivoting, a hinge 32 is provided to pivotably couple the lid 30 to the receptacle 20 adjacent the rim 26.

The lid 30 is preferably a substantially rigid construct which is non-foraminous and capable of maintaining an at least partially vacuum condition within an interior space of the receptacle when the lid 30 is in a closed position. This seal is preferably partially provided in the form of a ceiling 34 formed in the lid 30. This ceiling 34 is separate from the liner 25 but performs a function somewhat similar to that of the liner 25 in that it is preferably an easily cleanable surface which can optionally be made removably should it become soiled, damaged or otherwise require replacement or removal for cleaning.

A gasket 36 preferably surrounds a perimeter of the lid 30 and attaches to a perimeter of the lid 30 surrounding the ceiling 34. This gasket 36 is preferably formed of a resilient material, such as rubber, and has a generally annular form. The gasket 36 is adapted to abut the rim 26 of the receptacle 20 and be sandwiched between a perimeter of the lid 30 and the rim 26. The gasket 36 can be compressed somewhat when forces are applied thereto, such as by action of the clamp 60 and lever 50. With the gasket 36 so compressed, a substantially completely airtight seal is provided between the lid 30 and receptacle 20, such that a vacuum or partial vacuum state can be maintained within the interior space of the receptacle 20.

A pivot 38 is provided adjacent the rim 26 of the receptacle 20 and on a side of the receptacle 20 opposite the hinge 32. This pivot 38 provides a point for coupling of an attached end 52 of the lever 50 to the receptacle 20 to facilitate easy and secure closing of the lid 30, as described in detail below.

Figures 6, 7, 8, 9:
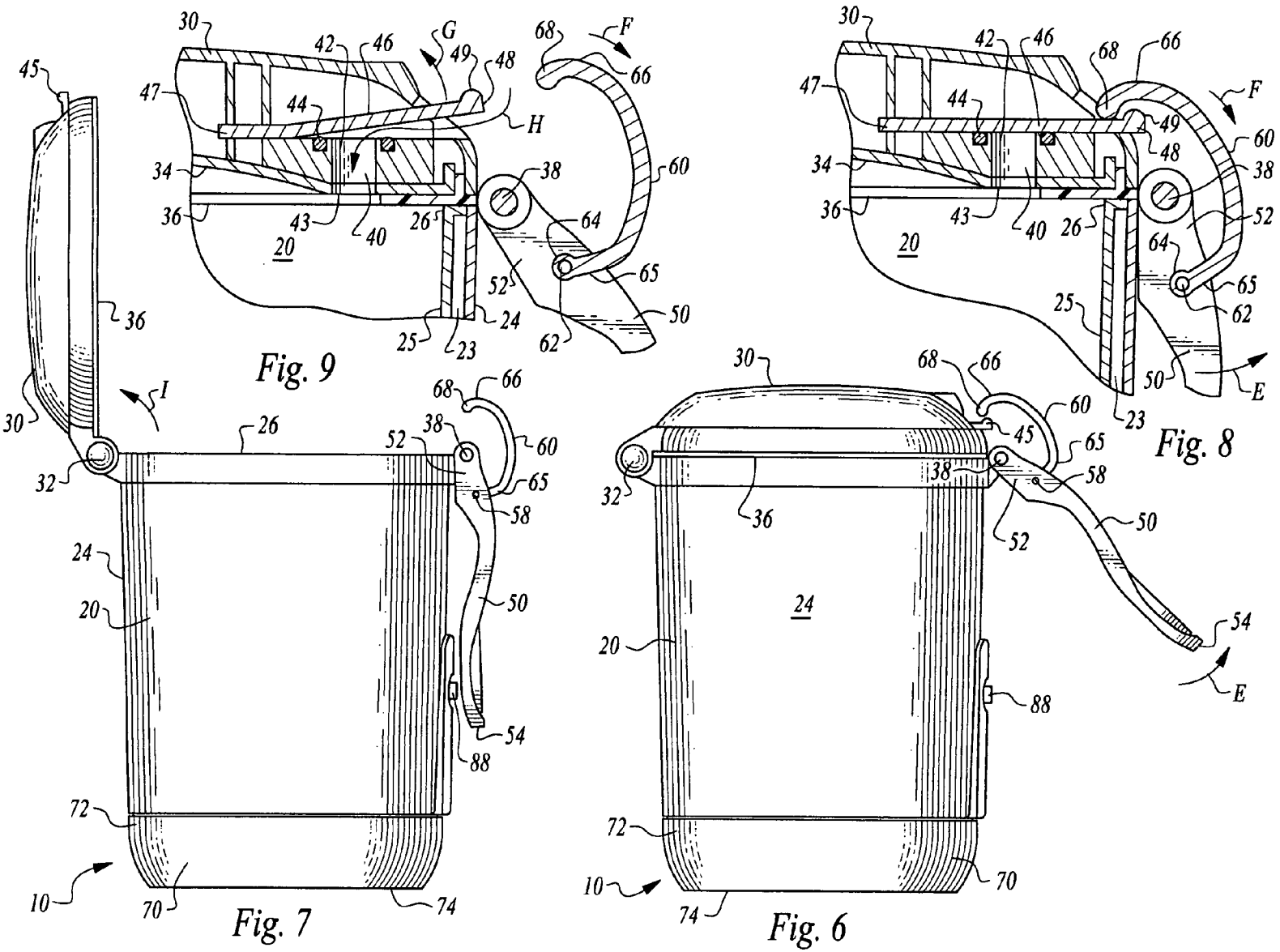
FIG. 6 is a front elevation view of that which is shown in FIGS. 1-3 with the container beginning to undergo an opening procedure.
FIG. 7 is a front elevation view of that which is shown in FIG. 1 after the container has been completely opened.
FIG. 8 is a sectional view of a detail of a portion of that which is shown in FIG. 5 and particularly showing details of a bleed port and associated valve for providing pressure equilibrium before opening of the vacuum storage container of this invention.
FIG. 9 is a sectional detail view similar to that which is shown in FIG. 8 but after pivoting of a lever thereof toward an open position and allowing opening of a bleed port to provide equilibrium between an interior of the container and a surrounding atmosphere before opening of a lid of the container.

With particular reference to FIGS. 5, 8 and 9, particular details of the bleed port 40 are described according to a preferred embodiment. The bleed port 40 is preferably located within the lid 30, but could alternatively be provided at some other location extending between an interior space within the container 10 and a surrounding atmosphere. The port 40 beneficially provides for pressure equalization between the interior space of the receptacle 20 and a surrounding atmosphere, such as to more conveniently allow the lid 30 to be opened.

The bleed port 40 is essentially a pathway extending through the lid 30 between a surrounding atmosphere and an interior space of the receptacle 20. In particular, the bleed port 40 preferably includes an entry 42 at an upper end thereof an a mouth 43 at a lower end thereof. The entry 42 is surrounded by an O-ring 44 which provides a preferred form of seal. A valve plate 46 is located overlying the entry 42. This valve plate 46 includes a fixed end 47 lateral to the entry 42 and a free end 48 at an end of the valve plate 46 opposite the fixed end 47. The free end 48 preferably terminates in a lip 48 which is raised upward slightly.

The valve plate 46 is a substantially rigid structure which exhibits a small degree of resilient elastic flexibility, such as that exhibited by a leaf spring. The valve plate 46 is held securely near the entry 42 in an initial unloaded position which is spaced slightly away from the entry 42 so that the entry 42 is open. The bleed port 40 is thus biased toward an open position allowing for air to communicate between a surrounding atmosphere and the interior space within the receptacle 20. Such a condition maintains equilibrium between the interior and exterior of the container 10, even when the lid 30 is in a closed position.

However, when sufficient forces are applied downward upon the valve plate 46, the valve plate 46 is sufficiently flexible that it can be pivoted downward to overlie the entry 42 and compress the O-ring 44. The valve plate 46 is sufficiently smooth and abuts the O-ring 44 sufficiently completely that the valve plate 46 seals off the entry 42 of the bleed port 40. In this way, the bleed port 40 can be selectively closed. One means for closing this valve within the bleed port 40 is by action of the clamp 60 down on the free end 48 of the valve plate 46, as described in detail below.

With particular reference to FIGS. 1-3 and 5-9, particular details of the lever 50 and clamp 60 are described. The lever 50 and clamp 60 preferably provide multiple different functions according to this invention. First, the clamp 60 and lever 50 act as a toggle mechanism to allow a relatively low amount of force applied to a distal end 54 of the lever 50 to provide a relatively high amount of closure force on the lid 30 to compress the gasket 36 and provide a tight seal between the lid 30 and rim 26 of the receptacle 20. Second, the lever 50 is preferably configured so that when it is pivoted to the closed position that it causes the switch 86 of the pump 80 to be actuated, causing the pump 80 to be activated and commence operation drawing air or other gases out of the receptacle 20. Third, the lever 50 acts on the clamp 60 causing the clamp 60 to apply a downward closing force on the valve plate 46 within the bleed port 40, so that the bleed port 40 is closed and a vacuum or partial vacuum condition can be created within the receptacle 20.

In particular, the lever 50 is preferably a substantially rigid elongate structure extending from the attached end 52 where it is pivotably attached to the receptacle 20 through the pivot 38, and a distal end 54. The distal end 54 is configured to be easily gripped by fingers or a palm of a hand of a user for applying forces to cause the lever 50 to pivot. This distal end 54 also includes a surface which can abut the switch 86 of the pump 80 to activate the pump 80.

The lever 50 preferably includes a pair of forks 56 which mount to opposite ends of the pivot 38. Pivot holes 58 are also formed in these forks 56 through which a pin 62 can pass. A sleeve 64 of the clamp 60 resides on this pin 62 so that the clamp 60 is pivotably attached to the lever 50 about this pin 62 and the pivot holes 58 of the lever 50. Other forms of attachment between the clamp 60 and lever 50 could also be provided, including a non-pivoting structure if the clamp 60 has sufficient flexibility.

The clamp 60 extends from a lever end 65 including the sleeve 64 to a port end 66 most distant from the lever end 65. The clamp 60 preferably has a somewhat curving from between the lever end 65 and the port end 66 with a knob 68 located at the port end 66. The knob 68 is provided to abut the valve plate 46 adjacent and just beyond the lip 49 at the free end 48 of the valve plate 46. In this way, the clamp 60 is prevented from slipping off of the valve plate 46, but rather securely engages the valve plate 46 when the lever 50 is pivoted downward, so that the clamp 60 can effectively close the valve plate 46 and close the bleed port 40.

The clamp 60 continues to apply a force on the valve plate 46 not only closing the valve plate 46, but also pushing through the valve plate 46 and against structures of the lid 30 surrounding the bleed port 40, so that the clamp 60 continues to apply a downward force upon the lid 30 so that the lid 30 can compress the gasket 36 between the lid 30 and the rim 26 of the receptacle 20. The downwardly applied forces of the clamp 60 thus simultaneously both close the bleed port 40 and seal the lid 30 against the rim 26 of the receptacle 20.

With particular reference to FIGS. 1-5, details of the base 70 of the container 10 are described. The base 70 provides a preferred region in which the vacuum pump 80, batteries 90 and pressure sensor 100 can reside. In particular, the base 70 includes a perimeter joint 72 secured to a lower end of the side wall 24 of the receptacle 20. A foot 74 defines a lower end of the base 70 and allows the entire container 10 to rest securely upon an adjacent underlying surface. A void 76 is provided within the base 70 for containment of the pump 80, batteries 90 and sensor 100. A door 78 is provided on the base 70 to allow access to the batteries 90, and particularly for changing of the batteries 90 when their charge has been depleted.

The pump 80 resides within the void 76 of the base 70. The pump 80 can be any form of pump suitable for drawing a vacuum on an adjacent chamber. Most preferably, this pump 80 is thus a form of positive displacement pump, such as a piston pump, gear pump (including both parallel axis gear pumps and concentric axis, gerotor-type gear pumps) or peristaltic pumps.

The pump 80 has an inlet 82 which preferably passes through the floor 22 in the receptacle 20 and into the gap 23. The pump 80 preferably includes an outlet 24 adjacent the door 78 of the base 70. Preferably, the door 78 is threaded with relatively loose threads into the base 70. In this way, air or other gases drawn out of the interior space by the pump 80 are merely released into the void 76 of the base 70 and allowed to migrate out of the base 70 through gaps in the threads surrounding the door 78. As an alternative, a separate outlet port could be provided in the foot 74 as shown in FIG. 4.

A circuit is provided for coupling the pump 80 to the batteries 90 and also to the pressure sensor 100. This circuit can take on a variety of different forms but would typically involve electric wires joining the separate elements in the circuit together. This circuit would also include a switch 86 coupled with wires to other components within the circuit. The switch 86 has an open position and a closed position which can be selected by depressing a button 88. When the button 88 is depressed, the switch moves to a closed position, so that electric current can flow from the batteries 90 to the pump 80. When the button 88 is released, the switch 86 is opened and the pump 80 ceases operation.

Most preferably, this switch 86 and button 88 are each located on a side of the receptacle 20 adjacent the lever 50. In this way, when the lever 50 is pivoted down toward the closed position, the distal end 54 of the lever 50 abuts the button 88 of the switch 86, and causes the button 88 to be depressed. This in turn causes the pump 80 to be activated.

The batteries 90 preferably include a support housing 92 which has a standard configuration for containment of a series of batteries. In one typical embodiment, four "AA" type 1.5 volt batteries are supplied to provide 6.0 volts and sufficient current for operation of the pump 80 and otherwise energizing the circuit. Pumps 80 having different power requirements could be met by other battery 90 arrangements, or other power sources.

The sensor 100 includes an input 102 most preferably in communication with the gap 23 through the sensor hole 28. The sensor 100 preferably is coupled to the circuit and has a switch therein which can cause the circuit to be deactivated when a pressure is sensed which is sufficiently low to cause a desired level of vacuum to be provided within the receptacle 20. Thus, even when the button 88 is depressed and the switch 86 closed, the pump 80 will still not operate when a sufficient pressure exists within the receptacle 20. When both a pressure above the set pressure is detected and the button 88 is depressed, then the pump 80 is allowed to operate, until a pressure condition is achieved which is below the set pressure point, at which time the pump 80 is deactivated. To avoid frequent cycling of the pump 80, two pressure set points can be established with the pump 80 staying on until the lowest pressure set point is reached and the pump 80 only coming back on when the second higher pressure set point is reached.

While the pump 80 is preferably located in the base 70, it could alternatively be in the lid 30. In such an alternative arrangement, the batteries 90 or other power source could also be in the lid 30 or could be in the base 70 or elsewhere. The switch 86 would typically remain on the side or could also be on the lid 30 with the clamp 60 optionally modified to activate the switch when the lever 50 and clamp 60 are moved to the closed position. The pressure sensor 100 would also typically be located in the lid 30 in such an alternative embodiment.

In use and operation, and with particular reference to FIGS. 5-9, details of the use and operation of the container 10 of this invention are described according to the preferred embodiment. Initially, when the user wishes to store a food item or other product within the container 10, the user configures the container 10 a shown in FIG. 7. With the lid 30 open, the user can place items to be stored in a vacuum condition within the receptacle 20. Next, the lid 30 is closed by rotation opposite to the direction indicated by arrow I (FIG. 7).

The user then lifts the lever 50 (along arrow E of FIG. 6) until the knob 68 of the clamp 60 is over the lip 49 of the valve plate 46 of the bleed port 40. The user then moves the lever 50 in the direction opposite that shown by arrow E in FIG. 6. As the lever 50 is rotated downward towards its closed position, the clamp 60 follows along arrow F and the lever 50 and clamp 60 act together as a toggle with a significantly greater force applied by the clamp 60 onto the lid 30 through the valve plate 46 than the amount of force actually being applied by the user on the distal end 54 of the lever 50.

This closure force on the lid 30 causes the gasket 36 to be compressed between the lid 30 and the rim 26 so that an airtight seal is provided between the lid 30 and the rim 26 of the receptacle 20. Also, this clamp 60 closure force pivots the valve plate 46 (in a direction opposite arrow G of FIG. 9) to a closed position.

Finally, as the distal end 54 of the lever 50 approaches the side wall 26 of the receptacle 20, further motion of the distal end 54 causes it to depress the button 88 of the switch 86 (arrow D of FIG. 5). With the switch 86 actuated, the pump 80 is activated and begins to draw a vacuum on the interior space within the receptacle 20. In particular, the pump 80 begins to operate drawing air or other gases first out of the interior space to the gap 23 through the liner 25 (along arrow A of FIG. 40), then out of the gap 23 and into the pump 80 (along arrow B of FIGS. 4 and 5). This air or other gases is discharged from the pump 80 through the outlet 84 (along arrow C of FIG. 4) which either then filters through threads holding the door 78 onto the base 70 or is provided through a separate hole passing through the door 78 in the base 70.

Pressure within the interior space of the receptacle 20 is reduced as air or other gases are drawn out of the interior space of the receptacle 20 through the evacuation ports 27 in the liner 25 due to the pressure differential between the gap 23 and the interior space within the receptacle 20. This pressure reduction continues until the sensor 100 detects a pressure below a threshold low pressure set point for the interior space of the receptacle 20. For instance, the sensor 100 can be set with a threshold pressure of 0.15 psi, indicative of an amount of pressure that is one percent of standard atmospheric pressure. Other pressure could be selected either by user adjustability of the sensor 100 or set by the manufacturer.

When this threshold pressure is reached, the control system associated with the sensor 100 causes power to be cut off from the pump 80 and the pump is deactivated. One way to configure this control system is to merely route electric power from the batteries through the sensor 100 to the pump 80 (and also through the switch 86). The sensor 100 can be configured so that when the pressure set point is reached, the circuit is open so that electric current from the batteries 90 to the pump 80 is disrupted. To the extent necessary, the sensor 100 can be powered by the batteries 90 so that the sensor 100 always receives power even when the pump 80 does not receive power either due to the pressure set point being reached or the switch 86 being deactivated. Alternatively, the sensor 100 can be configured in a circuit so that it does not receive power when the switch 86 is open.

The user can then carry the container 10 and its contents where desired while maintaining a vacuum condition within the interior space of the receptacle 20 of the container 10. When the user wishes to retrieve items from within the receptacle 20, the user follows the following procedure. Initially, one challenge faced by the user is that the lid 80 is held down by atmospheric pressure against the rim 26 of the receptacle 20. Hence, the lid 30 can be difficult to lift, even if the lever 50 and clamp 60 are moved to release the lid 30. With this invention, pressure equalization through the bleed port 40 alleviates this problem.

In particular, the user initially lifts the lever 50 (along arrow E of FIG. 6) toward an open position. This in turn causes the clamp 60 to rotate up and away from the valve plate 46. When the clamp 60 is rotated sufficiently so that the knob 68 is lifted off of the lip 49 of the valve plate 46, the spring biasing of the valve plate 46 causes the bleed port 40 to transition to an open condition (along arrow G of FIG. 9). The valve plate 46 is configured so that the forces tending to return the valve plate 46 to its biased original position are greater than atmospheric pressure forces acting on the valve plate 46. Thus, the bleed port 40 readily opens once the clamp 60 has been removed from the valve plate 46 and pressure equalization occurs.

Beneficially, typically a sound is associated with air rushing into the receptacle 20 through the bleed port 40 (along arrow H of FIG. 9). This sound provides positive reinforcement to the user that the contents of the receptacle 20 have been kept in a vacuum state and are fresh and ready for use. If no such sound is heard, the user is signaled to check the contents carefully to make sure that no spoilage has occurred or other damage to contents within the receptacle 20. Once pressure equalization has occurred, the lid 30 can be opened (along arrow I of FIG. 7) so that contents of the receptacle 20 can be accessed.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. For instance, the shape of the container 10 could be changed in size or shape. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A vacuum storage container for storing items at below atmospheric pressure, comprising in combination:

a receptacle;

a lid adapted to be removably coupled to said receptacle and provide a substantially enclosed interior space;

a vacuum pump adapted to remove air from said interior space;

an openable and closable bleed port adapted to return air into said interior space when pressure equalization is desired;

wherein said bleed port includes at least one valve, said valve biased toward an open position facilitating air transfer between an exterior of said receptacle and said interior space;

wherein said lid is hingedly attached to said receptacle, said receptacle including a lever pivotably attached to said receptacle adjacent a rim of said receptacle, said lever adapted to pivot between an open position and a closed position, a clamp pivotably attached to said lever, said clamp adapted to engage a portion of said lid spaced from where said lid is hingedly attached to said receptacle, said clamp adapted to exert a closing force upon said lid when said lever is moved toward said closed position; and wherein said bleed port is located within said lid with an entry adjacent a surrounding atmosphere and a mouth open to said interior space when said lid is in a closed position adjacent said receptacle, said clamp adapted to apply a force on said valve of said bleed port sufficient to close said valve when said lever is moved toward said closed position.

2. The container of claim 1 wherein said lid is hingedly attached to said receptacle.

3. The container of claim 2 wherein a gasket is interposed between a perimeter of said lid and a rim of said receptacle, said gasket adapted to be compressed somewhat and substantially preclude air migration therethrough.

4. The container of claim 1 wherein said vacuum pump is coupled to at least one battery, said battery and said vacuum pump attached to said receptacle.

5. The container of claim 4 wherein said vacuum pump and said batteries are coupled together through an electric circuit, said electric circuit including a switch thereon for selectively providing and interrupting electric power between said battery and said vacuum pump.

6. The container of claim 5 wherein said lid is hingedly attached to said receptacle, said receptacle including a lever pivotably attached to said receptacle adjacent a rim of said receptacle, said lever adapted to pivot between an open position and a closed position, a clamp pivotably attached to said lever, said clamp adapted to engage a portion of said lid spaced from where said lid is hingedly attached to said receptacle, said clamp adapted to exert a closing force upon said lid when said lever is moved toward said closed position, said lever adapted to actuate said switch to cause electric power to pass from the battery to said vacuum pump when said lever is moved toward said closed position.

7. The container of claim 5 wherein said circuit includes a pressure sensor thereon, said circuit adapted to function as a control system with power to the vacuum pump disrupted when a pressure sensed by said pressure sensor is below a desired threshold level, such that said circuit can be interrupted and said vacuum pump closed either by actuation of said switch or by said pressure sensor detecting a sufficiently low pressure.

8. The container of claim 1 wherein said receptacle includes a substantially vertically extending side wall terminating at a rim, said rim adapted to abut said lid when said lid is closed, said receptacle including a liner inboard of said side wall, said liner spaced from said side wall by a gap, said receptacle including a floor below said liner and extending across a bottom of said receptacle, said floor including at least one opening for a pump inlet, with said pump located below said floor, said gap extending between said floor and said liner and with said pump inlet in fluid communication with said gap.

9. The container of claim 8 wherein said liner has at least one evacuation port therein through which air can migrate from an interior side of said liner to said gap between said liner and said side wall.

10. The container of claim 1 wherein said valve of said bleed port includes a flexible structure with a surface overlying said entry of said bleed port.

11. The container of claim 10 wherein said entry of said bleed port is surrounded by a seal, said seal adapted to be compressed when said flexible structure of said valve abuts said seal.

12. A container for storing comestibles in a rarefied atmosphere, comprising in combination:

a receptacle having a rim at an upper end thereof;

a lid pivotably attached to said receptacle, said lid adapted to abut and seal with said rim;

means to remove at least a portion of the gases within said receptacle;

a lever pivotably attached to said receptacle adjacent said rim and spaced from where said lid pivotably attaches to said receptacle;

a clamp attached to said lever, said clamp adapted to engage a portion of said lid spaced from where said lid pivotably attaches to said receptacle, said clamp adapted to secure said lid in a closed position substantially enclosing an interior space within said receptacle when said lever is pivoted to a closed position;

wherein an openable and closable bleed port is interposed between said interior space and a surrounding environment, said bleed port adapted to return air into said interior space when pressure equalization is desired;

wherein said bleed port includes at least one valve, said valve biased toward an open position facilitating air transfer between an exterior of said receptacle and said interior space; and wherein said bleed port is located within said lid with an entry adjacent a surrounding atmosphere and a mouth adjacent said interior space when said lid is in a closed position adjacent said receptacle, said clamp adapted to apply a force on said valve of said bleed port sufficient to close said valve when said lever is moved toward said closed position.

13. The container of claim 12 wherein said lever is adapted to abut and actuate a switch when said lever is pivoted to said closed position, said switch adapted to turn on said gas removal means.

14. The container of claim 13 wherein said gas removal means includes a vacuum pump attached to said receptacle.

15. The container of claim 14 wherein said pump is located within a base coupled to said receptacle and below an enclosed interior space of said receptacle, with said vacuum pump having an inlet in fluid communication with said interior space, said base of said receptacle also including at least one battery and a circuit coupling said battery to said pump through said switch.

16. The container of claim 15 wherein a pressure sensor is provided in fluid communication with said enclosed interior space, said pressure sensor adapted to turn off said pump when said pressure sensor detects a pressure below a preselected interior space desired pressure.

17. The container of claim 12 wherein said receptacle includes a side wall extending down from said rim to a base, wherein a liner is provided within an interior space of said receptacle with a gap between said liner and said side wall.

18. The container of claim 17 wherein at least one evacuation port is located within said liner, said evacuation port adapted to allow gases to pass from an interior side of said liner to said gap between said liner and said side wall, said at least one evacuation port open to said gas removal means.

19. The container of claim 18 wherein said gas removal means includes a vacuum pump located within said base, said receptacle including a floor spanning a width of said receptacle below said liner and above said pump with said gap extending between said floor and said liner, said floor including at least one hole therein adapted to allow gases to pass from said gap to said vacuum pump.

20. The container of claim 12 wherein said valve of said bleed port includes a flexible structure with a surface overlying said entry of said bleed port; and wherein said entry of said bleed port is surrounded by a seal, said seal adapted to be compressed when said flexible structure of said valve abuts said seal.

21. A vacuum storage container, comprising in combination:

an openable receptacle;

a vacuum pump adapted to remove gases from an interior space within said receptacle;

an openable and closable bleed port adapted to return gases into said interior space when pressure equalization is desired;

wherein said bleed port includes at least one valve, said valve biased toward an open position facilitating air transfer between an exterior of said receptacle and said interior space, wherein said lid is hingedly attached to said receptacle, said receptacle including a lever pivotably attached to said receptacle adjacent a rim of said receptacle adapted to abut said lid when said lid is in a closed position, said lever adapted to pivot between an open position and a closed position, a clamp pivotably attached to said lever, said clamp adapted to engage a portion of said lid spaced from where said lid is hingedly attached to said receptacle, said clamp adapted to exert a closing force upon said lid when said lever is moved toward said closed position, said lever adapted to actuate said switch to cause electric power to pass from the battery to said vacuum pump when said lever is moved toward said closed position; and wherein said bleed port is located within said lid with an entry adjacent a surrounding atmosphere and a mouth adjacent said interior space when said lid is in a closed position adjacent said receptacle, said clamp adapted to apply a force on said valve of said bleed port sufficient to close said valve when said lever is moved toward said closed position.

22. The vacuum storage container of claim 21 wherein said pump is attached to said receptacle along with a power supply and a switch interposed between said power supply and said pump, wherein an openable lid is coupled to said receptacle, said openable lid adapted to close said receptacle to substantially enclose said interior space, wherein a lever is pivotably attached to said receptacle, said lever adapted to be pivotable between an open position where said lid can be opened and a closed position where said lid is held closed, said lever adapted to actuate said switch when said lever is pivoted to said closed position.

23. The vacuum storage container of claim 22 wherein said lid is hingedly attached to said receptacle; and wherein a gasket is interposed between a perimeter of said lid and a rim of said receptacle, said gasket adapted to be compressed somewhat and substantially preclude air migration therethrough.

24. The vacuum storage container of claim 23 wherein said lever includes a clamp pivotably attached to said lever, said clamp having a knob at an end thereof most distant from said lever, said knob adapted to engage a portion of said lid spaced from where said lid is pivotably attached to said receptacle with said knob adapted to apply a closing force upon said lid when said lever is pivoted toward said closed position.

25. The vacuum storage container of claim 22 wherein said power supply includes at least one battery, and wherein said pump is coupled to a control system including a pressure sensor adapted to sense pressure within said substantially enclosed interior space, said control system adapted to deactivate said pump when a desirably low pressure is sensed within said interior space.

26. The vacuum storage container of claim 21 wherein said valve of said bleed port includes a flexible structure with a surface overlying said entry of said bleed port; and wherein said entry of said bleed port is surrounded by a seal, said seal adapted to be compressed when said flexible structure of said valve abuts said seal.

* * * * *